US005402300A

United States Patent [19]

Ikoma

[11] Patent Number: 5,402,300

[45] Date of Patent: Mar. 28, 1995

[54] COLLET LIFTING MECHANISM FOR DIE HANDLING UNIT

[75] Inventor: Kazuya Ikoma, Kyoto, Japan

[73] Assignee: Rohm Co., Ltd., Kyoto, Japan

[21] Appl. No.: 919,888

[22] Filed: Jul. 27, 1992

[30] Foreign Application Priority Data

Nov. 6, 1991 [JP] Japan ..... 3-290209

[51] Int. Cl.[6] ..... H01F 7/06; H01F 7/20

[52] U.S. Cl. ..... 361/144; 335/284; 335/18; 335/177; 335/255

[58] Field of Search ..... 335/284, 255, 258, 177–179, 335/284, 18; 361/144, 149, 147, 179, 194; 29/720

[56] References Cited

U.S. PATENT DOCUMENTS 4,370,693 1/1983 McDonald et al. ..... 361/145
4,429,342 1/1984 Heider ..... 361/152
4,797,994 1/1989 Michaud et al. ..... 29/720
4,910,633 3/1990 Quinn ..... 361/144
5,079,534 1/1992 Steingroever et al. ..... 335/284
5,173,673 12/1992 Weigand et al. ..... 335/18
5,234,530 8/1993 Freeman, III ..... 156/358

*Primary Examiner*—A. D. Pellinen
*Assistant Examiner*—Adity A. Krishnan
*Attorney, Agent, or Firm*—Brumbaugh, Graves, Donohue & Raymond

[57] ABSTRACT

A magnet is fixed to the inner surface of the ceiling of a cylinder-like yoke which is closed at the top, and a holding plate is attached to the yoke through a slider. A coil and collet are unitedly attached to the holding plate. When a current is passed through the coil, a force proportional to the current acts on the coil so that a constant load is applied to the collet.

3 Claims, 2 Drawing Sheets

COLLET LIFTING MECHANISM FOR DIE HANDLING UNIT

BACKGROUND OF THE INVENTION

The present invention relates to a collet lifting mechanism for a die handling unit of a die bonder.

Conventionally, in a die bonding process in which a pellet is bonded to a frame, a collet lifting mechanism shown in FIG. 4 is used. The collet lifting mechanism comprises a driven table 1 which is moved upward and downward by a force applied from the outside, a collet 3 connected to the driven table 1 through a spring 2, and a holding guide pate 4 which is attached to the driving table 1 to guide the vertical movement of the collet 3.

When a die bonding is to be performed by this collet lifting mechanism, a pellet 5 is adhered to the lower end of the collet 3, and the driven table 1 is downward moved. This downward movement causes the collet 3 connected to the table through the spring 3 to move downward, and then the pellet 5 adhered to the lower end reaches a surface of a frame 6 on which an adhesive 7 is applied. When the driven table 1 is moved further downward moved, the spring 2 stretches upward because the lower end of the collet 3 has already( reached the frame 6, and the pellet 5 is pressed by the restoring force of the spring against the frame 6 and fixed thereto by the adhesive 7.

In the above-described prior art collet lifting mechanism, since the lower end of the collet is pressed against a frame or the like by a spring force, the load is determined by the spring constant. Hence, such a mechanism has a problem in that owing to variations in thickness of pellets and frames, the bonding load is not constant so that it is impossible to perform a precise die bonding.

SUMMARY OF THE INVENTION

This invention has been conducted in view of the above-mentioned problem and has an object of providing a collet lifting mechanism for a die handling unit in which the bonding load is stable without being affected by variations in thickness of pellets and frames and which can perform a precision die bonding.

The collet lifting mechanism for a die handling unit of the invention comprises: a yoke; a magnet fixed to the yoke; a coil which is driven to relatively move with respect to the yoke by an electromagnetic force when a current is passed through the coil, the electromagnetic force being generated by the: current and a magnetic flux produced by the magnet; and a collet which is connected to the coil and relatively movable in the same direction as the coil.

According to the present collet lifting mechanism, when a current I is passed through the coil and the magnetic flux density of the magnet is constant, the force acting on the coil is proportional to the current I. Even if pellets and frames vary in thickness, therefore, the collet lifting mechanism can stably apply a constant load.

DETAILED DESCRIPTION OF THE INVENTION

Hereinafter, the present invention will be further described in detail by illustrating embodiments.

Figure 1:
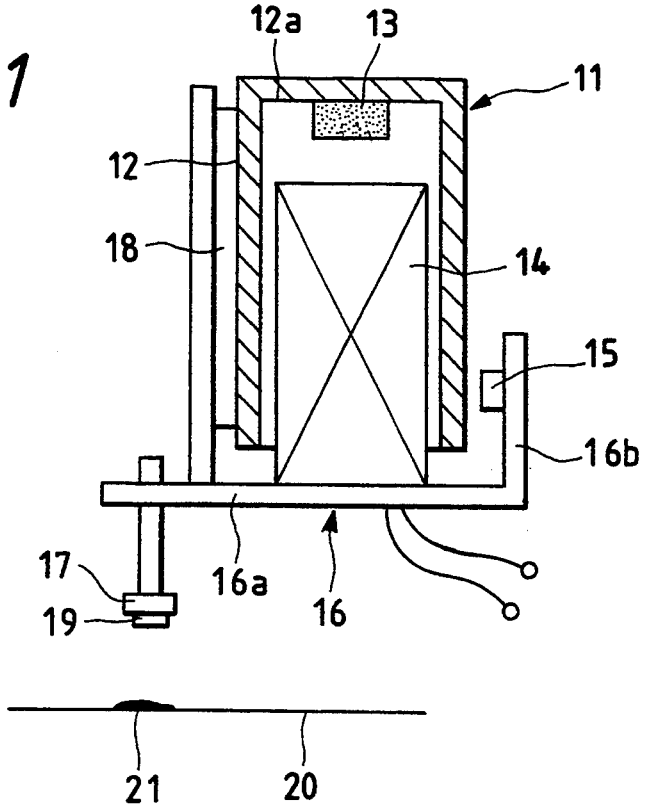
FIG. 1 is a diagram showing a collet lifting mechanism for a die handling unit which is an embodiment of the invention.

FIG. 1 is a diagram showing a collet lifting mechanism for a die handling unit which is an embodiment of the invention. In this embodiment, a voice coil motor (VCM) is employed as means for vertically driving a collet. In FIG. 1, the VCM 11 includes a cylinder-like yoke 12 which is closed at the top, a magnet 13 fixed to the lower surface 12*a* of the ceiling of the yoke 12, a coil 14, and a position sensor 15. The coil 14 is held by a horizontal portion 16*a* of a holding plate 16 which has an L-shape in a side elevation view. The position sensor 15 is attached to the vertical portion 16*b* of the plate. A collet 17 is unitedly connected to the holding plate 16. The holding plate 16 is attached to the fixed yoke 12 through a slider 18.

The outline of the operation of the embodiment will be described. When a current I is passed through the coil 14 in the initial state wherein the coil 14 is inserted in the yoke 12, an electromagnetic force expressed by $F=K.I.B$ (where B is the magnetic flux density caused by the magnet 13 and K is a constant) is generated. If the direction of the current is adequately set, the coil 14 is subjected to a downward force owing to the electromagnetic force so that the holding plate 16 moves downward along the slider 18. With this downward movement of the holding plate 16, also the collet 17 and the pellet 19 adhered to the lower end of the collet move downward, and then the pellet 19 is pressed against the surface of the adhesive 21 applied on a frame 20. The pressing force is proportional to the current I and irrespective of the thickness of the pellet 19 and frame 20, and therefore it is possible to apply a stable load.

Figure 3:
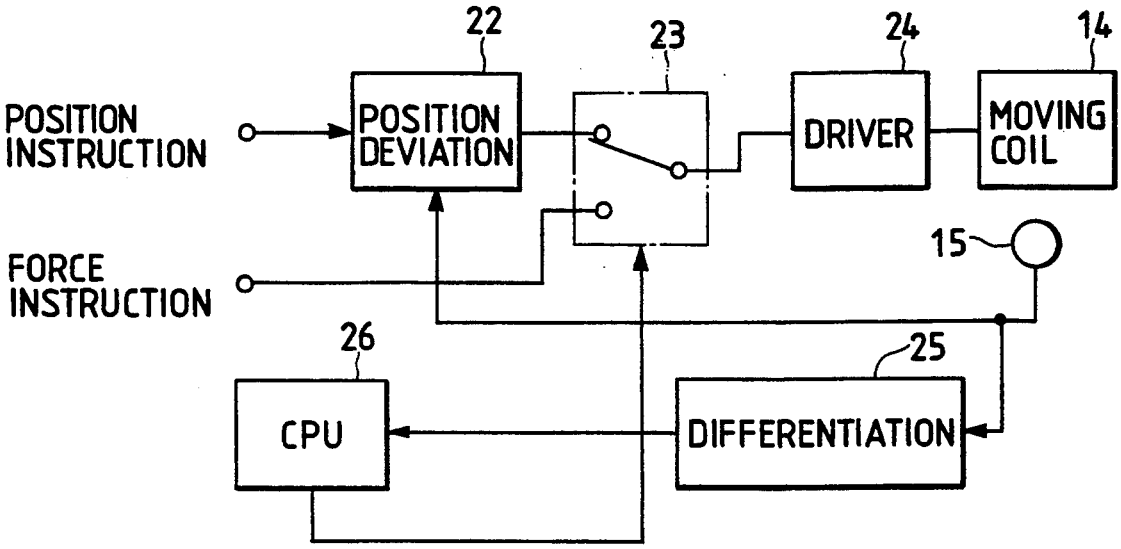
FIG. 3 is a block diagram showing a circuit for controlling the collet lifting mechanism for a die handling unit of the embodiment.
Figure 4:
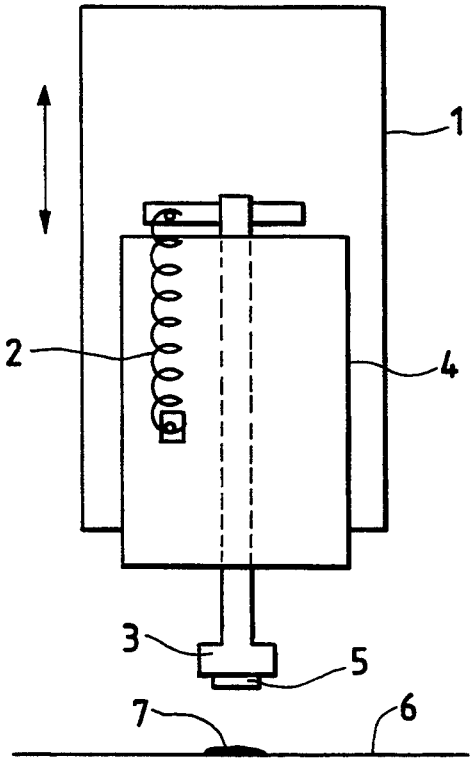
FIG. 4 PRIOR ART
FIG. 4 is a diagram showing a prior art collet lifting mechanism for a die handling unit.

Generally, a collet lifting mechanism for a die bonder has a stroke of about 10 mm. In the described embodiment, positioning and loading operations are separately controlled using the position detection sensor 15. A circuit for performing this control is shown in FIG. 3. According to this circuit, a position instruction signal and a position detection signal from the position detection sensor 15 are supplied to a positional deviation calculation circuit 22, and the positional deviation is supplied through a changeover switch 23 to a driver 24 which feeds a current to the moving coil 14. On the other hand, the detection signal from the position detection sensor 15, which is supplied to the positional deviation calculation circuit 22, is supplied also to a differential circuit 25 to be differentiated therein and the differentiated signal is supplied to a CPU 26. The changeover switch 23 receives a force instruction at the other input thereof, and the changeover operation of the switch 23 is controlled by the CPU 26.

Figure 2:
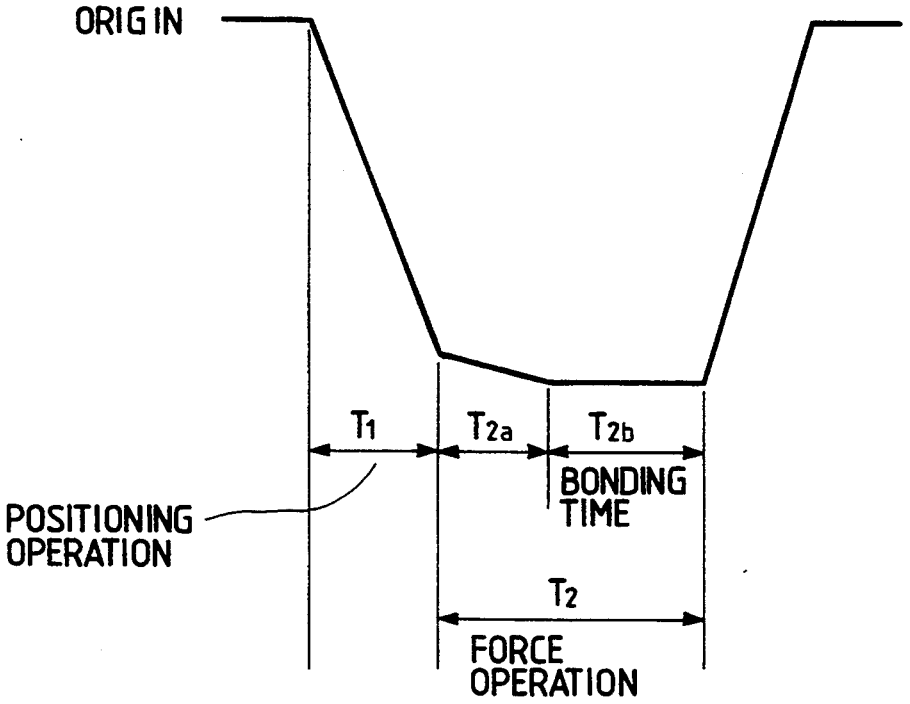
FIG. 2 is a time chart illustrating the operation of the collet lifting mechanism for a die handling unit of the embodiment.

Next, the positioning and loading operations of the embodiment will be described with reference to a time chart shown in FIG. 2. At the start of the control, the collet 19 is positioned at the origin, and then a current is passed through the coil 14 so that the collet 19 begins to move downward. In the period $T_1$, the positioning operation is performed while the output of the position detection sensor 15 is feedbacked.

When the pellet 19 rapidly descends to a position which is slightly higher than the frame 20 (for example, by about 100 um), the CPU 26 controls the changeover switch 23 so as to be switched to the side of the force instruction, whereby the process enters into the force operation period $T_2$. The first portion $T_{2a}$ of the force operation period continues until the pellet 19 reaches the frame 20, and the latter portion $T_{2b}$ is the die bonding period. During the period $T_{2b}$, a constant load is applied.

Preferably, a virtual positioning point may be set as a limiter at a position which is lower than the frame 20 by several hundreds um.

According to the present invention, since a force which is proportional to a current passing through the coil is applied as a load, the load is stably obtained without being affected by variations in thickness of pellets, collets, etc., whereby a uniform and high precision die bonding can be performed. The use of a VCM enables the load exerted at a collision between the pellet and the frame to become zero, thereby largely reducing the damage to the pellet.

I claim:

1. A collet lifting mechanism for a die handling unit, comprising:

a yoke;

a magnet fixed to said yoke;

a coil which is energizable to move relatively with respect to said yoke by an electromagnetic force when a current is passed through said coil, said electromagnetic force being generated by the current and a magnetic flux produced by said magnet;

a collet which is connected to said coil and relatively movable in the same direction as said coil;

position detecting means for detecting the position of the collet with respect to a desired collect engagement location; and control means responsive to the position detecting means for controlling the current supplied to the coil so as to control the force applied by the collet for a selected period of time after the collet has moved within the predetermined distance from the desired location.

2. A collet lifting mechanism as claimed in claim 1 wherein the position detecting means comprises a position sensor for detecting a position of a pellet adhered to said collet with respect to a frame to which said pellet is fixed.

3. A collet lifting mechanism as claimed in claim 2 wherein the control means comprises a positioning operation and a loading operation, said circuit comprising:

a positional deviation calculation circuit for receiving a position instruction signal for the positioning operation and a position detection signal from said position sensor to produce a position deviation signal;

a changeover switch for changing the position operation and the loading operation;

a driver for receiving the position deviation signal from said positional deviation calculation circuit or a force instruction signal for the loading operation through said changeover switch and for applying the current to said coil;

a differential circuit for differentiating the position detection signal from said position sensor; and a CPU for receiving the differentiated signal from said differential circuit and for controlling said changeover switch to change the position operation and the loading operation.

* * * * *